US011448492B1

(12) United States Patent
Futtere

(10) Patent No.: US 11,448,492 B1
(45) Date of Patent: Sep. 20, 2022

(54) BROADHEAD BLADE LOCK AND RELEASE APPARATUS AND METHOD

(71) Applicant: Matthew Futtere, Fredericksburg, TX (US)

(72) Inventor: Matthew Futtere, Fredericksburg, TX (US)

( * ) Notice: Subject to any disclaimer, the term of this patent is extended or adjusted under 35 U.S.C. 154(b) by 0 days.

(21) Appl. No.: 17/028,084

(22) Filed: Sep. 22, 2020

Related U.S. Application Data

(60) Provisional application No. 62/906,147, filed on Sep. 26, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 6,174,252 B1 * 1/2001 Mizek ..... F42B 6/08 473/583
6,287,224 B1 * 9/2001 Liechty, II ..... F42B 6/08 473/583
6,758,774 B2 * 7/2004 Liechty, II ..... F42B 6/08 473/584
6,830,523 B1 * 12/2004 Kuhn ..... F42B 6/08 473/583
7,393,295 B1 7/2008 Futterre
7,713,152 B1 * 5/2010 Tentler ..... F42B 6/08 473/583

* cited by examiner

*Primary Examiner* — John A Ricci
(74) *Attorney, Agent, or Firm* — J. Nevin Shaffer, Jr.

(57) ABSTRACT

A broadhead blade lock and release apparatus consisting of a support structure with a blade attached with the support structure such that the blade is movable from a first position to a second position. A pressure device is connected with the blade where the pressure device is configured to apply pressure to the blade. A blade lock is attached to the support structure such that when the blade is connected with the blade lock the blade is held in the first position by the pressure on the blade and where pressure on the blade releases the blade form the blade lock such that the tension device then pressures the blade to the second position.

20 Claims, 4 Drawing Sheets

BROADHEAD BLADE LOCK AND RELEASE APPARATUS AND METHOD

CROSS REFERENCE TO RELATED APPLICATION

This application claims the benefit of previously filed U.S. provisional patent application No. 62/906,147 filed Sep. 26, 2019 for a "Broadhead Blade Lock and Release Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a broadhead blade lock and release apparatus consisting of a support structure with a blade attached with the support structure such that the blade is movable from a first position to a second position. A pressure device is connected with the blade where the pressure device is configured to apply pressure to the blade. A blade lock is attached to the support structure such that when the blade is connected with the blade lock the blade is held in the first position by the pressure on the blade and where pressure on the blade releases the blade from the blade lock such that the pressure device then pressures the blade to the second position.

BACKGROUND OF THE INVENTION

Humane hunting requires a system for killing prey quickly. Problems exist with current hunting devices, bows and arrows and projectiles in particular, in that, for example, the killing area of the arrow or projectile is difficult to expand without introducing detrimental side effects.

A "broadhead", as is known in the art, is the sharpened implement, blade, mounted on the end of the shaft of an arrow that provides the penetrating and cutting mechanism which results in the ethical and humane killing of the hunted animal. While broadheads are useful hunting tools, they would be even more useful if they could be accurately delivered to the desired area of the animal. The evolution of the broadhead has gone from fixed bladed designs to "mechanical" designs. The "mechanical broadheads" are mechanically complex devices which deploy cutting blades at impact with a target. In particular, the blades of all mechanical broadheads remain dependent upon transferring some of the arrow's forward momentum energy for use in overcoming restrictive devices placed upon the blades that are intended to prevent premature deployment of the blades from their in-flight compressed position. The amount of momentum energy that is required to overcome the prior art compression devices varies but is of a significant enough magnitude that it prevents ethical use of mechanical broadheads by those bow hunters shooting legal, but less poundage of pull bows.

In addition, the momentum energy removed from the forward motion to overcome the restriction devices so as to enable the blades to deploy, results in a direct and negative outcome to target recovery rates due to not obtaining an exit wound. This is especially critical on marginally hit animals. In short, typically, prior art designs are required to remove enough energy so as to generate enough force to overcome a large magnitude of friction of the one time use, disposable blade holding mechanisms so as to break rubber bands, to shatter and/or permanently disfigure plastic collars, to cut through plastic pins or to cut O-rings, for example. Again, this reduction of energy significantly reduces the efficacy of prior art mechanical blades with their one time use disposable blade holding mechanisms.

Further, with the advent and availability of improved materials, the bow or crossbow for delivering the arrow has also improved considerably. Compound bows and crossbows are much more efficient than traditional equipment and result in the capability to launch arrows at considerably higher velocities. Unfortunately, these higher velocities introduce significant acceleration forces upon the broadhead. Even a slight momentary opening of a blade and re-closure from a closure mechanism that uses an elastic material results in significant erratic accuracy. This is a major problem and has resulted in increasing the "strength" of the closure mechanisms. This, however, increases the amount of energy required to be used in defeating the closure mechanism and further compounds the problem by reducing penetrating power where lethality studies demonstrate improvement to recovery rates of hit animals when complete pass thru of the target animal is achieved.

In short, there is a need in the art for maintaining effective control of blades from transport in the field, absorption of launch energies at the moment a shot is taken, through air and at impact with the target animal. It is crucial to success to amplify the efficiency and effectiveness of the use of forward momentum energy and to maintain as much of it as possible. In addition, it is desirable to ensure maintenance of structural integrity through mechanical simplicity so as to provide a narrow profile in flight and a maximum cutting surface length while transiting the target animal while maximizing efficient use of the majority of the forward momentum energy and the stored kinetic energy to humanely impact, completely pass through and quickly and ethically kill the targeted game animal are also desirable.

It is appropriate to note that Applicant has created a superior broadhead blade and air flow equalizer apparatus and method as set forth in his U.S. Pat. No. 7,393,295 incorporated herein by reference. In particular, this patent is for a broadhead designed for use in hunting of big game birds and is not generally applicable for use in hunting big game animals. As a result, problems still exist in the art as set forth above for pursuing big game animals. As such there is a need in the art for an apparatus and method for use with structures such as arrows, projectiles and such, that increases the area of impact without decreasing the important aspects of accuracy and maximum penetration and lethal cutting upon impact and thru the target animal. That is, there is a need for a broadhead arrow, for example only, with a wide impact area that maintains target tip like accuracy at any arrow velocity, that incorporates the ability to transit bone structures such as a rib cage in a game animal in a manner that significantly minimizes the amount of momentum energy lost to penetration, minimizes deflection, that reduces lateral drag on the arrow shaft, and that provides broad, lethal cutting surface exposure at all times. Further there is a need for a broadhead that is able during hard bone structure penetration to pass it with minimal momentum energy loss, yet which presents maximum cutting width within soft tissue vital organs once the cutting surfaces transit past the harder chest cavity surfaces such as rib cage bones both during entry and exit of the chest cavity and that is able to again exit the ribbed chest cavity should hard bone be encountered. Further, a need exists for an easy to attach and failure resistant broadhead that maximizes mechanical simplicity of design and increased structural integrity and that does not act as a barb when withdrawn.

By way of further explanation, all mechanical broadheads require momentum energy, removed from the finite energy transferred to them from the bow at release to penetrate an object, to overcome the resistance of the various closure mechanisms used in prior art devices to hold blades closed from launch to impact. At impact with the target, in prior art devices, continued forward movement of the blade is used to overcome, cut or break, the resistance mechanism used to prevent premature blade opening. Typical closure mechanisms used in the prior art are rubber bands, O-rings, plastic pins or plastic collars and similar friction inducing holding devices.

Again, such devices create problems, however. At launch from zero feet per second to some significantly higher feet per second, acceleration forces are applied to prior art designs that often cause momentary exposure of blade to air stream and/or complete breakdown of the holding mechanism resulting in full premature deployment of the blade or blades both of which cause a decrease in accuracy and penetrating force at impact.

In addition, through normal transport of broadheads in the field, blades can be, and are often, bumped and banged or catch upon things. This often results in allowing momentary, partial to full, premature deployment prior to launch and creates additional problems. One prior art problem is safety due to exposing a user to cutting surfaces where none were expected. Additionally, accuracy issues are created by partial or full premature deployment of the blades. Further, a user is unable to use a projectile that has been prematurely deployed until replacement of the holding device/closure mechanism. That is, many prior art closure devices are not reusable as they are designed to be sacrificial in nature. In fact, the majority of mechanical broadhead blade holding designs and/or closure mechanisms currently on the market are designed to be, and must be, totally replaced when stretched out of shape or when being damaged beyond use. This adds additional parts and pieces that must be brought along with the basic hunting equipment.

At minimum, the prior art devices often create a need to reset blades and/or to reach for another undamaged arrow during a time of being close upon the target animal which adds unnecessary movement and thus amplifies failure of the hunt through scaring off of the always vigilant target animal.

Applicant has observed that efficiency of forward momentum energy use is critical to achieve the desired complete pass through of a broadhead apparatus so as to enhance quick and humane killing of the target animal. Again, the prior art designs all use the forward momentum contained within the arrow/broadhead projectile upon impact to transfer energy to cut and or break the closure device so as to initiate the release of the mechanical closure devices. It has been observed that a large component of the forward momentum energy is used to initiate and complete the mechanical motion required break the closure device and release the blades to a fully operational position. This limits to a large degree the possible distance of the forward penetrating potential of the projectile.

That is, the magnitude of wasted forward momentum energy being converted to other mechanical motion eliminates and/or significantly inhibits the efficacy of these devices and reduces the choices and or use of the mechanical category of broadheads by those who use minimum legal draw weights. That is, some users must use those lower poundage bows to hunt with, such as women and young adults. This limitation also prevents those who can shoot higher poundage pull bows that deliver higher momentum energy from using the prior art mechanical broadheads. That is, Applicant knows that users are told by professional hunters and outfitters for larger animals such as elk, moose, eland, kudo, buffalo, etc. that they are not allowed to use prior art mechanical broadheads due to the inherent lack of penetration they deliver due to the problems of momentum energy wasted/used up in defeating the prior art closure devices.

Thus, there is a need in the art for an apparatus, method and process that addresses the aforementioned problems in a manner that is robust and flexible so as to accommodate a full spectrum of broadhead design and use.

It therefore is an object of this invention to provide an improved broadhead blade lock and release apparatus and method for increasing the penetrating power of a broadhead without reducing speed and accuracy and structural integrity.

SUMMARY

Accordingly, the novel broadhead blade lock and release apparatus utilizes the stored energy of a "pressure device", such as a spring, for example only and not by limitation, to provide locking force. The pressure device causes a blade or two opposing blades or plurality of blades to rotate to a position that is specifically designed to connect at a locking location on, and with, a blade lock and by applying pressure in this locked position to continuously prevent the expansion of a blade or blades when in the locked position. However, the novel and unique mechanics of the operation of the present invention requires a near zero use of forward momentum to unlock the blade or blades. It accomplishes this at impact by using the compressive force applied to the blade as it enters a target, upon the blade edges. This minimum amount of energy is transferred by improved mechanical advantage to compress the blade or blades slightly. This slight movement of compressing the blade, or plurality of blades, frees the mechanical connection of the blade or blades with the blade lock. Once the blade or blades are unlocked the blade or blades are then pressured, driven, by the pressure device to open to full cutting width at the second position so as to deliver maximum lethal damage. By using very little energy to unlock the blade or blades, the present invention thereby makes the most efficient and effective use of essentially all available forward momentum energy to achieve the maximum desirable pass thru potential. The blade lock, with or without secondary blades as will be described more fully hereafter, once disconnected from the blade is free to rotate, move linearly or move in a combination of ways, out of the way upon an axle or similar mechanism.

To be clear, the blade or blades pass through three positions in operation: a first position is the locked and ready to shoot position; another position is the temporary compressed position during which the blade(s) is released from the blade lock; and a final, second, position where the blade(s) is released from the blade lock and pressured to the wide open full cutting width position. For clarity, the blade(s) is described herein as having two operating positions, locked in the first position and unlocked in the second position.

As used herein all terms are given their common, "ordinary" meaning. In particular, the term "blade" is used as discussed herein and illustrated in the figures to describe a generally flat device which has a length, width and thickness and whose width and length are much larger than the thickness. A knife blade for example, only.

The term "pressure device" is used herein to describe a device that is resilient and that deforms under pressure but returns to a resting state or position after pressure is withdrawn. A resilient metal spring, for example only, once formed stays in a resting position and when compressive pressure is applied deforms, compresses, and once the pressure is released, the spring returns, expands, to its resting position. Thus, in operation, the pressure device exerts a pressure against movement or a resisting pressure when pressure is applied. Many rubber, foam, metal and plastic devices are known which exhibit such qualities and are well within the abilities of those of ordinary skill in the art.

In another aspect of the invention, the at least one blade includes an interaction of a single pressure device connected with the at least one blade. In another aspect, the pressure device holds the at least one blade at the first position and then, when the blade is unlocked, holds the at least one blade in the second position. In the second position, the pressure device extends the blade to the extended position and, however, compresses or yields to force on the blade edges, as when the blade hits a bone, so as to allow the blade to compress and pass the bone. Once past the bone, for example, the pressure device forces the blade back out to its full cutting width second position.

In another aspect, the pressure device is a spring. In one aspect, there is a pressure application device, such as a ball bearing or similar lode bearing device, which transfers stored spring energy from the pressure device to a blade or plurality of blades efficiently and with great minimization of wear surfaces via the friction induced via that mechanical interaction and repetitive motion.

According to another embodiment of the invention, a compressible cutting width broadhead apparatus includes two or more blades connected within a recess in a support structure where the two blades include a leading edge and a trailing edge and where the two blades are movable from a first position to a second position. A pressure device includes a first contact point and a second contact point such that one contact point is connected with each of the two blades where the pressure device maintains the two blades at the first position when no compressive force is applied to the two blades and where the pressure device maintains contact with the two blades and yields when compressive force is applied to the leading edge of a blade such that at least one blade moves to a third, compressed, position and where when the compressive force is removed from the leading edge the pressure device forces the blades to the extended second position.

In another aspect, the support structure includes a first end and a second end and where the first end is connected to an arrow shaft and where an arrow tip is connected with the second end. In a further aspect, the first position is a fixed position away from the support structure, the second position is a position toward the arrow tip away from the first position and the third position is a position inward from the first position toward the support structure.

In one aspect, the two blades include a slot or hole or locking recess within the blade or blades and/or trigger mechanism and the pressure device is connected with the two blades at either above or below the blade or plurality of blades.

In another aspect, the pressure device is a spring, with a base topped with a hardened ball bearing or other wear surface, connected with the blade or plurality of blades and placed under pressure. In one aspect, the locking mechanism is moved and or/rotated to pass through a region of interaction. When pressure is removed from blade/plurality of blades at this position of the other blade/plurality of blades and/or trigger mechanism the primary blade/plurality of blades are physically prevented from opening, locked, by means of the receptive geometrical shape of primary blade interacting with the receptive geometrical shape of the secondary blade/plurality of blades and/or trigger locking/release mechanism.

In one aspect, the two blades include a slot or hole or locking recess within the blade or blades and/or trigger mechanism and the pressure device is connected with the two blades at either above or below the blade or plurality of blades. In another aspect, the pressure device is a spring with a base topped with a hardened ball bearing or wear surface is connected with the blade or plurality of blades and placed under pressure.

In one aspect, the blade locking mechanism is moved and or/rotated to pass through a region of interaction. When pressure is removed from blade/plurality of blades at this position of the other blade/plurality of blades and/or trigger mechanism the primary blade/plurality of blades are physically prevented from opening with the receptive geometrical shape of primary blade interacting with the receptive geometrical shape of the secondary blade/plurality of blades and/or trigger locking/release mechanism.

In another embodiment, the present invention pertains to broadhead blade lock and release apparatus with a support structure. A blade is attached with the support structure such that the blade is movable from a first position to a second position. A pressure device is connected with the blade where the pressure device is configured to apply pressure to the blade. A blade lock is attached to the support structure such that when the blade is connected with the blade lock the blade is held in the first position by the pressure on the blade and where compressive force on the blade releases the blade from the blade lock such that the pressure device then pressures the blade to the second position.

In another aspect, the blade includes a length with a first end and a second end and a blade lock connector in the first end where the blade lock connector is configured to connect the blade with the blade lock in the first position.

In another aspect, the pressure device applies pressure to the first end of the blade in both the first position and the second position and in one aspect, the blade lock connector is an extension from the first end of the blade and the blade lock includes a receiver within which the extension is retained in the first position.

In one aspect, the apparatus further includes more than one blade.

In one aspect, the apparatus includes a rear blade. In a further aspect, the blade lock is in the rear blade.

In another aspect, the apparatus further includes more than one blade and more than one rear blade.

In one aspect, the apparatus further includes a pressure application device between the pressure device and the blade and where the pressure application device is a ball bearing.

According to another embodiment, a broadhead blade lock and release apparatus consists of a support structure with a front and a back. Two front blades are attached with the support structure at the front of the support structure such that the two front blades are movable from a compressed first position to an extended second position. A pressure device is connected with the two front blades where the pressure device is configured to apply pressure to the two front blades in both the first position and the second position. A blade lock is attached to the support structure such that when the two front blades are connected with the blade lock the two front blades are held in the compressed first position by the pressure on the blades and where compressive force on the two front blades releases the two front blades from the blade lock such that the pressure device then pressures the two front blades to the extended second position.

In one aspect, this apparatus further includes two rear blades.

In another aspect, the two rear blades include the blade lock.

In a further aspect, the blade lock connector is an extension from the first end of the two front blades and the blade lock includes a receiver within which the extensions are retained in the first position.

In one aspect, the apparatus further includes a pressure application device between the pressure device and the blade and where the pressure application device is a ball bearing.

In one aspect, the pressure device is a spring.

In a further aspect, the support structure includes an arrow shaft connected to the back and an arrow tip connected with the front.

According to another embodiment, a broadhead blade lock and release method consists of:

a. providing a support structure; a blade attached with the support structure such that the blade is movable from a first position to a second position; a pressure device connected with the blade where the pressure device is configured to apply pressure to the blade; and a blade lock attached to the support structure such that when the blade is connected with the blade lock the blade is held in the first position by the pressure on the blade and where compressive force on the blade releases the blade from the blade lock such that the pressure device then pressures the blade to the second position; and b. the pressure device applying pressure to the blade.

In one aspect, the method further includes more than one blade.

In another aspect, the method further includes a rear blade.

In a further aspect, there are more than one blade and more than one rear blade and where the blade lock is in the more than one rear blade.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
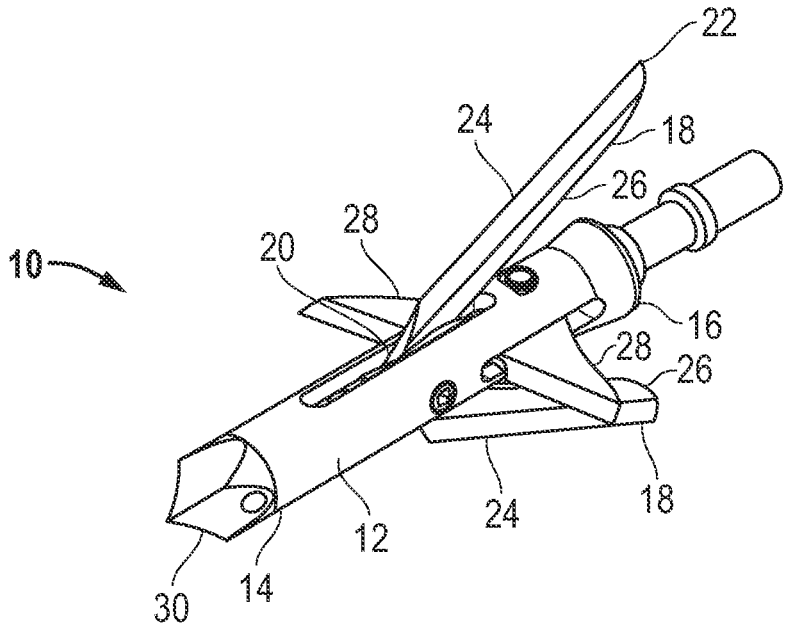
FIG. 1 is a perspective view of the broadhead blade lock and release apparatus with two front blades and two rear blades in the closed and locked position.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
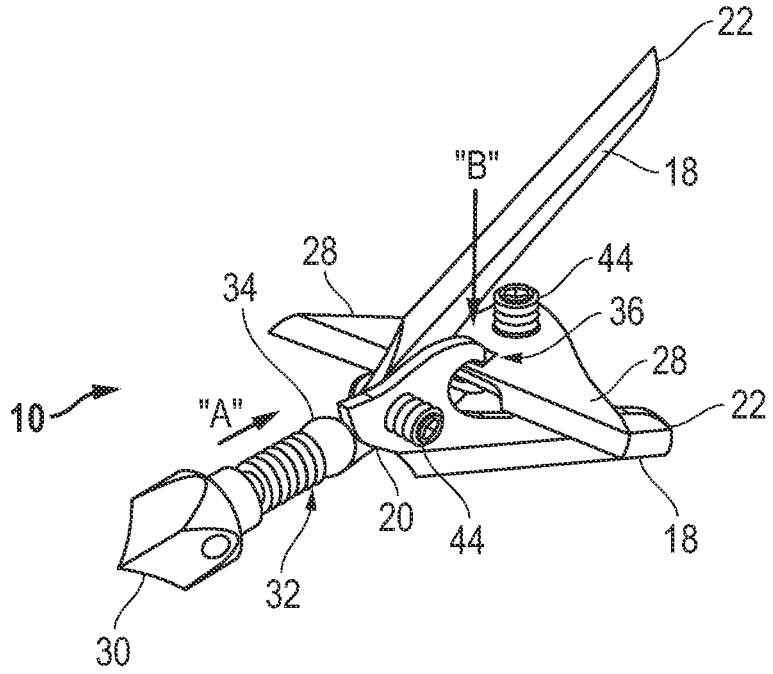
FIG. 2 is a cut away perspective view of the invention of FIG. 1 without the support structure and showing the internal mechanics of the pressure device and the blade lock.
Figure 3:
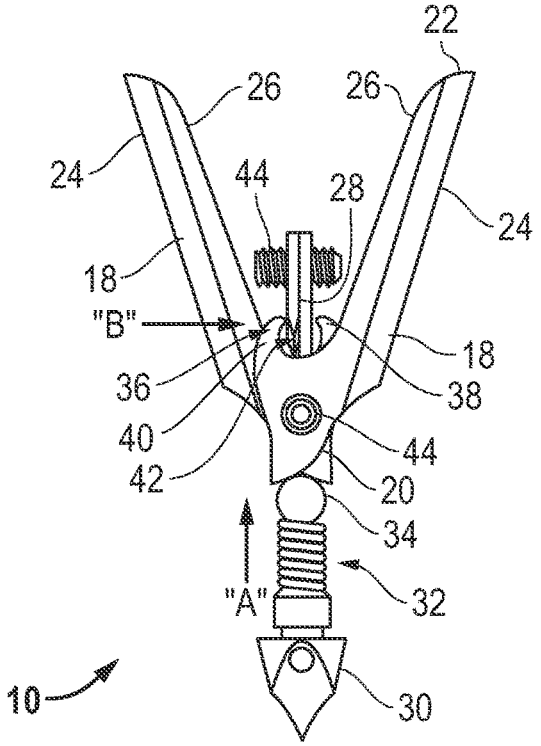
FIG. 3 is a cut away side view of the invention of FIG. 2.
Figure 4:
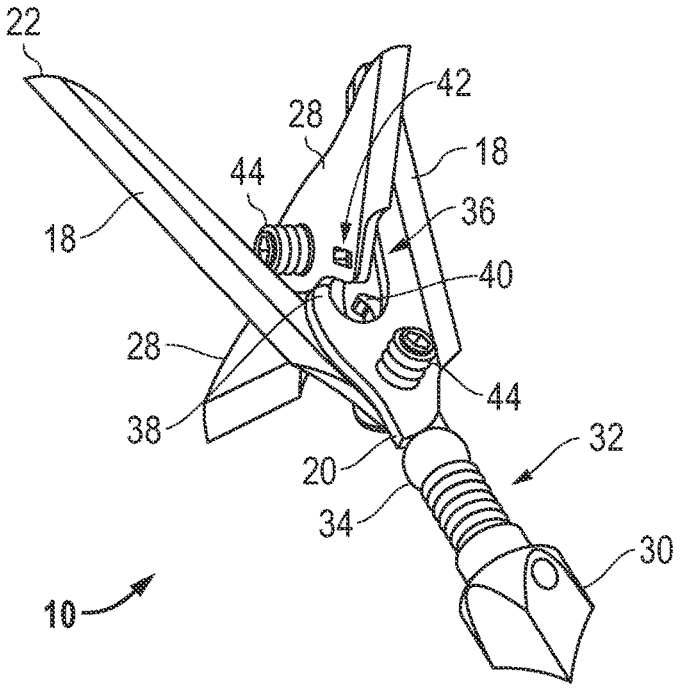
FIG. 4 is a cut away perspective view showing two front blades released from the blade lock.
Figure 5:
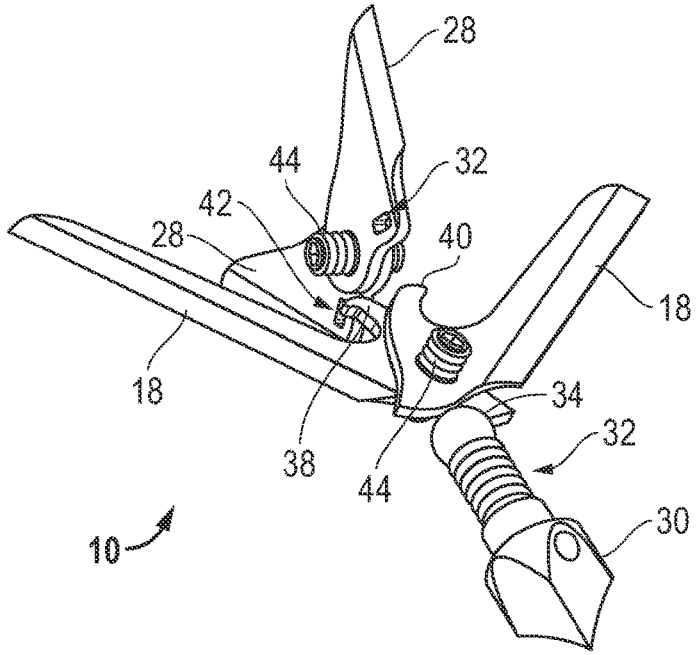
FIG. 5 is a perspective view of the invention of FIG. 4 showing two front blades being moved by the pressure device to the extended position.
Figure 6:
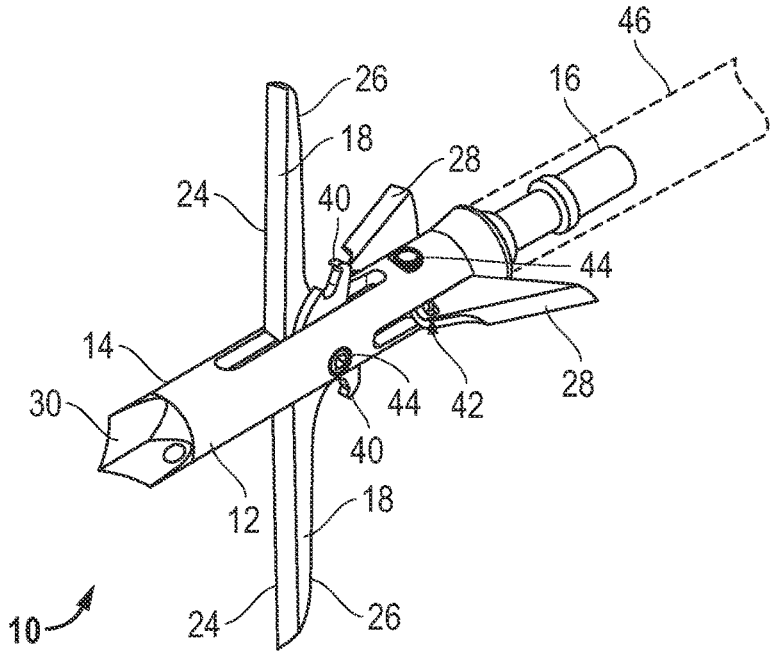
FIG. 6 is a perspective view of the invention of FIG. 1 with two front blades fully extended and two rear blades in the deployed, extended, positions.
Figure 7:
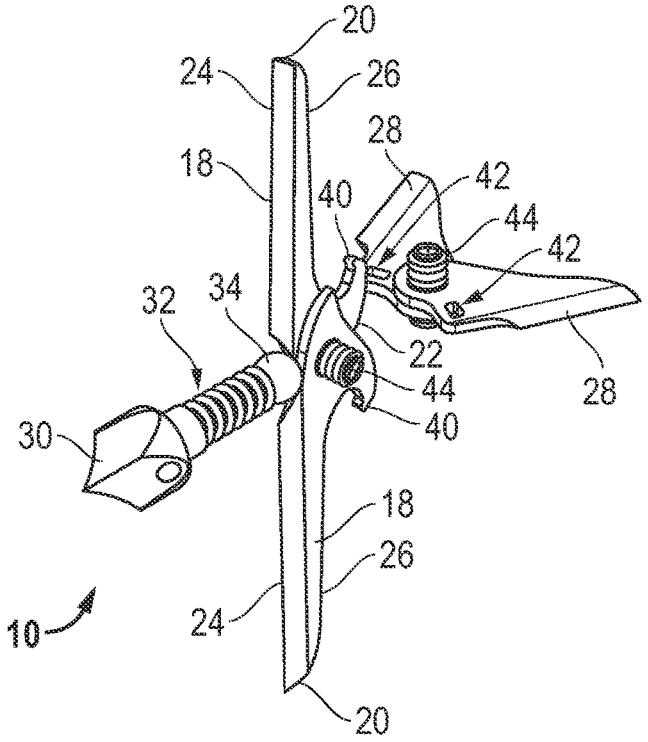
FIG. 7 is a cut away perspective view the invention of FIG. 6 without the support structure.
Figure 8:
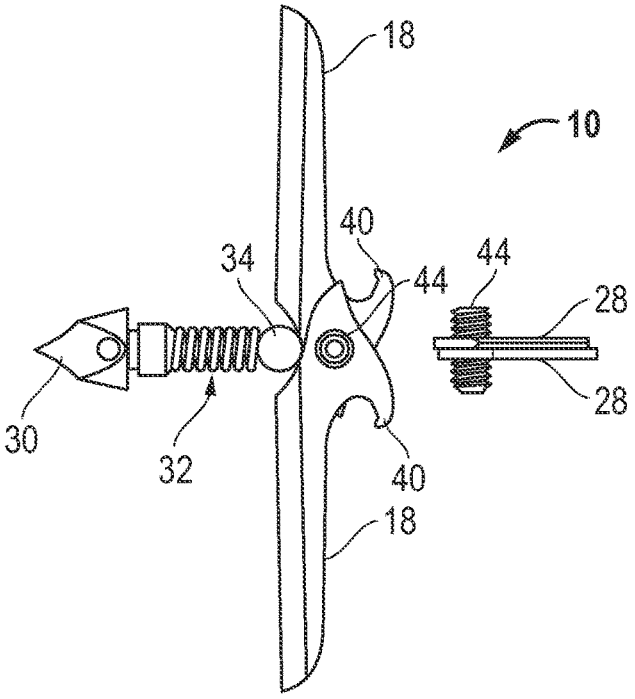
FIG. 8 is a side cut away view of the invention of FIG. 7.

One embodiment of the present invention is illustrated by way of example in FIGS. 1-8. Referring to FIGS. 1-3, a broadhead blade lock and release apparatus 10 consists of a support structure 12 with a front 14 and a back 16. A "front" blade 18 is attached with the support structure 12 such that the blade is movable from a first ("locked" "un-deployed") position as shown in FIGS. 1-3 to a second ("unlocked" "deployed") position as shown in FIGS. 6-8 as will be discussed more fully hereafter. Front blade 18 has a first end 20, a second end 22, a cutting edge 24 and a trailing edge 26. The term "front" is used to describe its location relative to any other blade, such as a rear blade described hereafter, along the support structure 12. That is front blade 18 is located nearer the front 14 of support structure 12 than a rear blade, as shown in the figures.

As shown, preferably there are two front blades 18 and once in the locked, first, position they can not be physically unlocked as will be described more fully hereafter. FIG. 1 also illustrates a preferred embodiment, when present, with two rear blades 28 attached to support structure 12 as well. Additionally, FIG. 1 shows an arrow tip 30 connected to support structure 12 at the front 14.

Referring to cutaway FIG. 2, broadhead blade lock and release 10 is shown in the "locked position". Pressure device 32 is shown, for example only and not by limitation, located in front of front blades 18 within support structure 12 (not shown for clarity). Pressure device 32 is connected with, and applies pressure to, the front blade 18 in the locked, first, position. As shown, pressure deice 32 is configured to also apply pressure the front blade 18 to the second "unlocked" position shown in FIGS. 6-8 and discussed more fully hereafter. Pressure device 32 may be a spring, as shown, or any other pressuring device now known or hereafter developed. In one aspect, Applicant has found that providing a pressure application device 34 between the pressure device 32 and the blade 18 is preferred and where the pressure application device 34 is a ball bearing as shown.

Importantly, blade lock 36 is attached the support structure 12 such that when the front blade 18 is connected with the blade lock 36 the front blade 18 is held in the "locked" first position by pressure on the front blade 18 from pressure device 32. Blade lock 36 preferably includes a blade lock connector 38. In one aspect, the blade lock connector 38 is an extension 40 from the first end 20 of the front blade 18 as more clearly shown in FIG. 3. As shown, extension 40 is "hooked shaped" such that extension 40 is configured to fit within a receiver 42 in blade lock 36.

Referring to FIG. 2 again, the present invention is shown in the locked position where the front blades 18 are connected with blade lock 36 by means of, preferably, the connection of blade lock connector 36, extension 40, with receiver 42. When so situated, pressure device 32 applies pressure on the first ends 20 of front blades 18 in direction of pressure arrow "A" in FIG. 2. This pressure forces front blades 18 such that extension 40 is forced into receiver 42 and forcibly held there by the pressure in direction of pressure arrow "B". Preferably, front blades 18 are rotatably attached to the support structure by means of rotatable connection 44. Certainly any other form of connection now known or hereafter developed that enables the function of the invention as disclosed is included herein.

Once in the locked first position, front blades 18, and rear blades 28 when present, are positively held against movement without any closure devices, such as rubber bands, etc. According to Applicant's unique structure, the front blades 18 are only released from the locked first position when the front blades 18 are forced or compressed inward toward the support structure 12 as happens when the device enters a target. At that moment, a small amount of momentum is used to compress the blades 18 which releases the front blades 18 from the blade lock 36. At that point, the same pressure provided from pressure device 32 on the first ends of front blades 18 pressures the front blades 18 to the "unlocked" "fully extended" yet compressible second position as shown releasing and opening in FIGS. 4 and 5 and in the unlocked position most clearly in FIGS. 6-8.

The figures illustrate a preferred embodiment where the rear blades 28 also act as, or include, the blade lock 36. That is, the rear blades 28 preferably include the receiver 42 which, in combination with the blade connector 38, extension 40 on front blades 18, for example only and not by limitation, hold both the front blades 18 and rear blades 28 from movement. Once the blades are unlocked, as just described, in operation, rear blades 28 freely rotate around rotatable connection 44, for example only and not by limitation, to the second position for the rear blades 28 as illustrated in FIGS. 5-8. Certainly, blade lock 36 may be present and not in the form and structure of rear blades 28. What is required by the invention is that placing the front blade or blades 18, as preferred, in the locked first position, requires connection of the blade lock connector 38, in some form, with the receiver 42, in some form, while at the same time pressure device 32 is applying pressure to the first ends 20 such that the front blades 18 are positively held in the locked first position as described.

FIGS. 4-5 illustrate the effect of inward, compressive, pressure on the cutting edges of front blades 18 which cause the front blades 18 to release and unlock from the blade lock 36. This, again, allows the pressure that pressure device 32 is constantly applying to front blades 18 to move them toward the forward, deployed, second position shown in FIGS. 6-8. The unlocking also releases rear blades 28, and or independent blade lock 36 without blades, to move, or preferably rotate, toward the back 16 of support structure 12 as shown.

FIGS. 6-9 illustrate the invention with the front blades 18 in the fully deployed second position and FIG. 6 shows a dashed line outline of an arrow shaft 46 attached to the back 16 of support structure 12 as will be the case in most instances of use of the present invention.

By way of further description, in one embodiment, a broadhead blade lock and release apparatus consists of a support structure with a front and a back. Preferably, two front blades are rotatably attached with the support structure at the front of the support structure such that the two front blades are movable from a compressed first position to an extended second position. A pressure device is connected with the two front blades where the pressure device is configured to pressure the two front blades to the second extended position. A blade lock is attached to the support structure, preferably below the two front blades, such that when the two front blades are connected with the blade lock the two front blades are held in the first position by the pressure on the blades to the extended second position. Compressive pressure on the cutting edges of the two front blades toward the support structure releases the two front blades from the blade lock such that the pressure device pressures the two front blades to rotate to the second position.

By way of additional description, placing the apparatus in the "locked" first position is accomplished by compressing the two main (larger blades) front blades 18 until they cannot be compressed any farther, as, for example, by hitting mechanical stop limits on support structure 12. At that point, blade lock 36, in the preferred form of the two rear (smaller) blades 28, are rotated forward toward the front 14 of support structure 12. The smaller rear blades 28 include the invention's unique geometry, such as receiver 42, such that they provide a locking opportunity for the main two front blades 18. Front blades 18 also include unique geometry (extensions 40 for example only) to create a blade lock connector 38 to connect with the two rear blades 18 (by means of receiver 42 for example only). The internal spring force (by means of pressure device 32 for example) now ensures that the pin like features of the front blades (extensions 40) are forced into the receptive component geometry of the two rear blades (receivers 42). Thus, firm mechanical locking is established and the broadhead is ready to shoot. There are NO rubber bands, plastic/rubber clips, O-rings, plastic pins, friction bumps/inserts or any other such additional temporary, lesser strength blade locking mechanisms that must be overcome by using precious forward momentum penetrating energy. This new and novel approach to mechanical blade entrapment and release has never been done and is by far the strongest ever invented. The mechanism, blade lock 36 with front blades 18, would have to be broken to unlock the apparatus. Instead with mere ounces of compressive pressure, created by penetration of the target, applied to the main two front blades 18, blade lock 36 is simply unlocked and all four blades (when present) fully deploy with no waste of forward momentum energy.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A broadhead blade lock and release apparatus comprising:

a. a support structure;

b. a blade attached with the support structure such that the blade is movable from a first position to a second position wherein the blade includes a length with a first end and a second end and a blade lock connector in the first end wherein the blade lock connecter is configured to connect the blade with the blade lock in the first position;

c. a pressure device connected with said blade wherein said pressure device is configured to apply pressure to said blade; and d. a blade lock attached to the support structure such that when the blade is connected with the blade lock said blade is held in the first position by the pressure on the blade and wherein compressive force on the blade releases the blade from the blade lock such that the pressure device then pressures the blade to the second position.

2. The apparatus of claim 1 wherein the pressure device applies pressure to first end of the blade in both the first position and the second position.

3. The apparatus of claim 1 wherein the blade lock connector is an extension from the first end of the blade and the blade lock includes a receiver within which the extension is retained in the first position.

4. The apparatus of claim 1 further including more than one blade.

5. The apparatus of claim 1 further including a rear blade.

6. The apparatus of claim 5 wherein the blade lock is in the rear blade.

7. The apparatus of claim 5 further including more than one blade and more than one rear blade.

8. The apparatus of claim 1 further including a pressure application device between the pressure device and the blade and wherein the pressure application device is a ball bearing.

9. A broadhead blade lock and release apparatus comprising:

a. a support structure with a front and a back;

b. two front blades attached with the support structure at the front of the support structure such that the two front blades are movable from a compressed first position to an extended second position;

c. a pressure device connected with said two front blades wherein said pressure device is configured to apply pressure to said two front blades in both the first position and the second position;

d. a blade lock attached to the support structure such that when the two front blades are connected with the blade lock said two front blades are held in the compressed first position by the pressure on the blades and wherein compressive force on the two front blades toward the support structure releases the two front blades from the blade lock such that the pressure device then pressures the two front blades to the extended second position; and e. two rear blades.

10. The apparatus of claim 9 wherein the two rear blades include the blade lock.

11. The apparatus of claim 9 wherein a blade lock connector is an extension from the first end of the two front blades and the blade lock includes a receiver within which the extensions are retained in the first position.

12. The apparatus of claim 9 further including a pressure application device between the pressure device and the blade and wherein the pressure application device is a ball bearing.

13. The apparatus of claim 12 wherein the pressure device is a spring.

14. The apparatus of claim 9 wherein the support structure includes an arrow shaft connected to the back and an arrow tip connected with the front.

15. A broadhead blade lock and release method comprising:

a. providing a support structure; a blade attached with the support structure such that the blade is movable from a first position to a second position; a pressure device connected with said blade wherein said pressure device is configured to apply pressure to said blade; and a blade lock attached to the support structure such that when the blade is connected with the blade lock said blade is held in the first position by the pressure on the blade and wherein compressive force on the blade releases the blade from the blade lock such that the pressure device then pressures the blade to the second position and further including a rear blade; and b. said pressure device applying pressure to said blade.

16. The method of claim 15 further including more than one blade.

17. The method of claim 15 wherein there are more than one blade and more than one rear blade and wherein the blade lock is in the more than one rear blade.

18. A broadhead blade lock and release apparatus comprising:

a. a support structure;

b. a blade attached with the support structure such that the blade is movable from a first position to a second position;

c. a pressure device connected with said blade wherein said pressure device is configured to apply pressure to said blade;

d. a blade lock attached to the support structure such that when the blade is connected with the blade lock said blade is held in the first position by the pressure on the blade and wherein compressive force on the blade releases the blade from the blade lock such that the pressure device then pressures the blade to the second position; and c. a rear blade.

19. A broadhead blade lock and release apparatus comprising:

a. a support structure with a front and a back;

b. two front blades attached with the support structure at the front of the support structure such that the two front blades are movable from a compressed first position to an extended second position;

c. a pressure device connected with said two front blades wherein said pressure device is configured to apply pressure to said two front blades in both the first position and the second position;

d. a blade lock attached to the support structure such that when the two front blades are connected with the bade lock said two front blades are held in the compressed first position by the pressure on the blades and wherein compressive force on the two front blades toward the support structure releases the two front blades from the blade lock such that the pressure device then pressures the two front blades to the extended second position; and e. a blade lock connector wherein the blade lock connector is an extension from the first end of the two front blades and the blade lock includes a receiver within which the extensions are retained in the first position.

20. A broadhead blade lock and release method comprising:

a. providing a support structure; a blade attached with the support structure such that the blade is movable from a first position to a second position; a pressure device connected with said blade wherein, said pressure device is configured to apply pressure to said blade; and a blade lock attached to the support structure such that when the blade is connected with the blade lock said blade is held in the first position by the pressure on the blade and wherein compressive force on the blade releases the blade from the blade lock such that the pressure device then pressures the blade to the second position wherein there are more than one blade and more than one rear blade and wherein the blade lock is in the more than one rear blade; and b. said pressure device applying pressure to said blade.

* * * * *